United States Patent [19]

Ramm et al.

[11] Patent Number: 4,806,098

[45] Date of Patent: Feb. 21, 1989

[54] HEAT TRANSFER AND STABILIZING APPARATUS

[76] Inventors: Eric J. Ramm, 10 Immarna Street, Lilli Pilli, N.S.W. 2229; Wilhelmus J. Bukyx, 12 Newland Place; John G. Padgett, 45 Waratah Road, both of Engadine, N.S.W. 2233; Alfred E. Ringwood, 3 Vancouver Street, Redhill, A.C.T. 2603, all of Australia

[21] Appl. No.: 884,982

[22] Filed: Jul. 14, 1986

[30] Foreign Application Priority Data

Jul. 16, 1985 [AU] Australia ..... PH01497

[51] Int. Cl.[4] ..... F27B 15/00; B65D 6/12

[52] U.S. Cl. ..... 432/215; 220/85 B; 432/216

[58] Field of Search ..... 432/215, 216, 217; 220/85 B, 22.3

[56] References Cited

U.S. PATENT DOCUMENTS

| | | | |
|---|---|---|---|
| 2,737,453 | 3/1956 | Larsen | 220/85 B |
| 2,924,350 | 2/1960 | Greer | 220/85 B |
| 3,172,348 | 3/1965 | Berg | 220/85 B |
| 4,121,091 | 10/1978 | Wareham | 432/215 |
| 4,305,428 | 12/1981 | Burton | 220/85 B |
| 4,549,673 | 10/1985 | Kupersmit | 220/85 B |

*Primary Examiner*—Henry C. Yuen

*Attorney, Agent, or Firm*—Ladas & Parry

[57] ABSTRACT

A metal compressible bellows-type container or canister is used in a hot uniaxial pressing process with a mixture of high level radioactive nuclear waste material and a synthetic rock forming material filling the canister. The canister has a bottom wall, a convoluted bellows-like side wall, a lid or top wall and transverse metal apertured plates dividing the canister into three equally sized zones. Preferably the apertures are of a clover leaf configuration and are located at the center of the plates. Cylindrical liners can be provided to maintain a zone between each liner and the bellows-like side wall to prevent ingress of the particulate mixture of waste and synthetic rock forming material.

8 Claims, 2 Drawing Sheets

HEAT TRANSFER AND STABILIZING APPARATUS

FIELD OF THE INVENTION

This invention relates to a container having heat transfer characteristics such that particulate material within the container can be heated quickly and uniformly.

The invention in one important embodiment is applicable to a metal container which is in the form of a compressible bellows type canister and which is used in a high temperature and pressure sintering process for immobilising high level radioactive nuclear waste material in a synthetic rock structure.

BACKGROUND OF THE INVENTION

During such a process there is a preheating phase for the purpose of bringing the canister and contents up to a suitable temperature before pressure can be applied for the formation of the synthetic rock structure. Typically an induction heating arrangement is utilized whereby the bellows-type canister has its walls subjected to a temperature of about 1200° C. and there is a temperature gradient through the body of particulate material which is located in the canister for forming subsequently in the process the synthetic rock structure. Pressure cannot be applied until all of the material within the bellows-type canister exceeds a thresh hold temperature for the process, typically 1100° C.

In the process, the bellows-type canister is subjected to hot uniaxial pressing and it is important to have a canister arrangement which compresses in a predictable and reliable manner to facilitate subsequent packing of canisters into a storage container and to avoid the risk of failure of the bellows as a reliable container. This risk would be unacceptable if the container were compressed in a manner which had uncontrolled deformation.

SUMMARY OF THE INVENTION

The present invention is directed to providing new and useful alternatives to previous proposals.

According to one aspect of the present invention, there is provided a method of heating material within a container characterised by the steps of:

providing a container having a thin metal wall of generally cylindrical form with at least one apertured plate which is of a thermally conductive material and which extends generally transversely and interiorly of the container and is attached in thermally conducting relation to the wall of the container;

at least partially filling the container with a solid particulate material to be heated therein, such that the or at least one of the apertured plates is embedded in the material; and applying heat to the container for heating the container and its contents.

According to another aspect of the invention, there is provided a metal container for heating solid particulate material contained therein, which container comprises a thin outer wall of generally cylindrical form and at least one apertured plate which is of thermally-conductive material and which extends generally transversely and interiorly of the container and is attached in thermally conducting relation to the outer wall of the container.

PREFERRED FEATURES OF THE INVENTION

Preferably, the or each plate is of a metallic material and extends in a plane normal to the axis of the container, which is preferably of circular cross-section.

In a preferred embodiment the aperture in a plate is substantially of a "four leaf clover" configuration in the central region of the plate.

In a preferred embodiment, the container is generally cylindrical and the or each apertured plate is of a predetermined strength sufficient to prevent gross radial deformation of the container and displacement of end walls of the container transversely to the axis of the container during a subsequent hot uniaxial pressing of the free-standing container along an axis at right angles to the general plane of the or each apertured plate. Desirably, apertured plates of metal are placed at substantially equally spaced positions along the length of the container and are welded to a respective wall section thereof, this allows the container to be longer than otherwise possible and enables rapid heat up of material within the container.

In a preferred embodiment, the container is cylindrical and its side wall has a bellows-like configuration. Advantageously, such a bellows container may include a cylindrical screen (or liner) located adjacent the bellows-like wall of the container, such that it extends between the container ends and the apertured plate(s) for the purpose of preventing the particulate material entering the zone of the bellows convolutions.

Preferably a series of holes are positioned around the periphery of the or each plate to enable air transfer between different compartments formed between the liner and the bellows convolutions. In a preferred option Zircaloy is placed in the compartments thus providing a means for disposing spent fuel sheaths.

Embodiments of the present invention will now be described by way of example and with reference to the accompanying drawings of which:

DETAILED DESCRIPTION OF THE INVENTION

Figure 1:
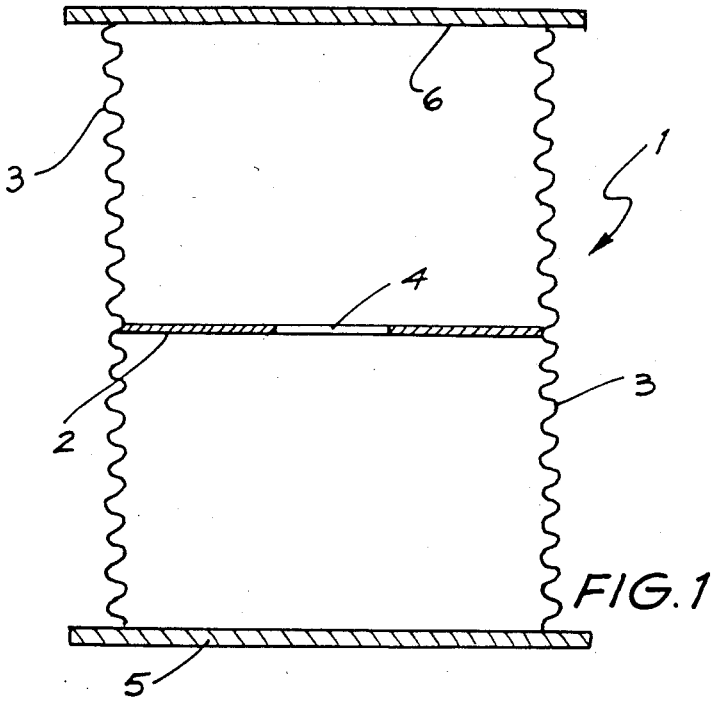
FIG. 1 is a side elevation of a first form of compressible bellows type canister.

In FIG. 1, there is shown a metal compressible bellows-type canister 1 for use in a hot uniaxial pressing process of a mixture of a high level radioactive nuclear waste material and a synthetic rock forming material, such as that described above, at high pressure and temperature. The canister 1 comprises bottom wall 5, convoluted bellows like side wall 3, top wall 6, and a transverse metal apertured plate 2. The metal plate 2 is welded at its periphery to a convolution of the convoluted side wall 3 of the canister, and has a central clover-leaf shape aperture 4.

Figure 3A:
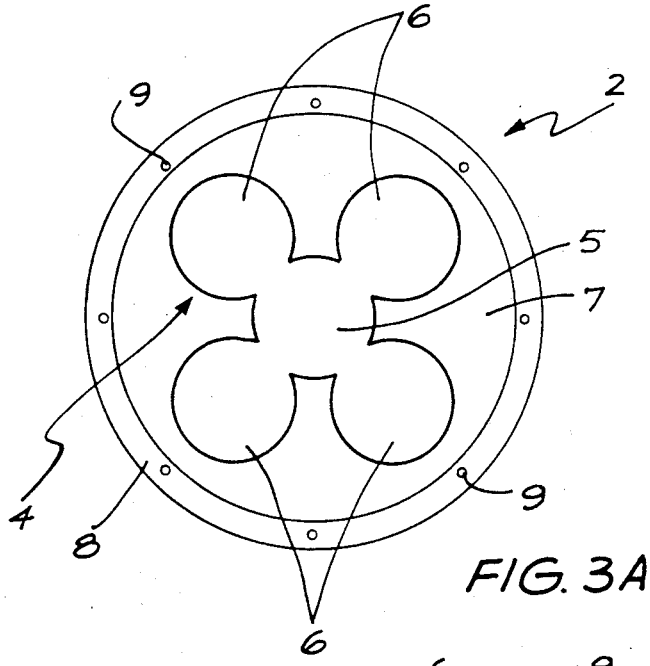
FIGS. 3A and 3B are respective plan and sectional side views of an apertured plate used in the canister shown in FIGS. 1 and 2.

As best shown in FIG. 3A this aperture 4 is in the centre of the plate 2 and has a four leaf clover configuration comprising a central, generally circular portion 5 and four circular lobe portions 6 each in communication with the circular portion. This four leaf clover configuration for the aperture 4 is provided in a central portion 7 of the plate 2, with a ring portion 8 extending around the periphery of the plate. The thickness of the central portion 7 of the plate 2 is, typically, 3 mm.

Typically, the metal plate is 430 mm in diameter, with each circular lobe 6 having a diameter of 110 mm and the distance between the centres of opposed lobes being 210 mm.

Figure 2:
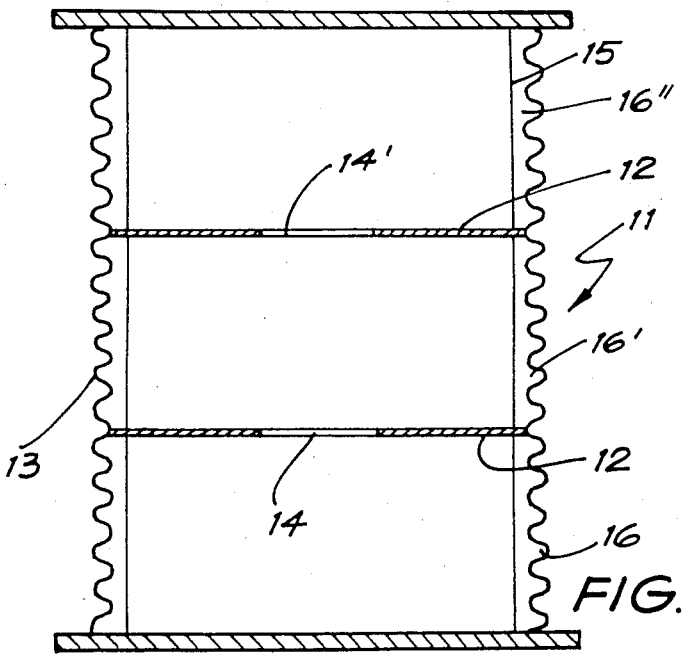
FIG. 2 is a side elevation of another form of a compressible bellows-type canister.
Figure 3B:
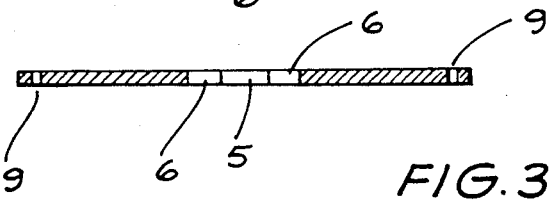

In FIG. 2, a second embodiment of container in accordance with the present invention is shown, which is similar to that described above in relation to FIGS. 1 and 3, except firstly that two spaced, apertured metal plates 12 are located transversely within the compressible bellows-type canister 11, thereby dividing the canister into three regions, secondly a thin cylindrical liner 15 which is slightly smaller in diameter than the internal diameter of the canister 13 is located axially inside the container in combination with the apertured metal plates 12, 12'.

The spaces 16, 16', 16" between liner 15 and the convoluted side wall 13 of the continer 11, prevent the mixture to be hot pressed in the canister from entering the convolutions thereof, thus allowing the density of the mixture to remain substantially uniform throughout the hot pressing process.

It is to be noted that this liner 15 can serve two functions. Firstly, when it is unfilled during the hot pressing process effected upon the canister 11 and when the canister is compressed as a consequence thereof, the intimate mixture of high level radioactive nuclear waste and synthetic rock forming materials does not enter the convolutions of the canister side wall 13.

Secondly, and alternatively, the spaces 16, 16', 16" can be filled with:

(i) small pieces of Zircaloy spent fuel sheaths which, as a result of the hot compressive process, are formed as a dense matrix, thus providing an option for the disposal of such spent fuel sheaths; or (ii) metal powder, such as stainless steel powder, which also hot presses to form a dense matrix and which adds an additional protective barrier to the synthetic rock formed in the compressed canister 11, as well as reducing the risk of the heated mixture from entering the convolutions, should the liner 15 fracture during the process.

The configuration of the aperture 14 and 14' and each plate 12 and securement of the latter to the respective convolutions of the canister wall 13 are identical to those for the first embodiment.

It should be noted that the embodiments described hereinbefore should in no way be taken as restricting the present invention. In fact, other embodiments are envisaged with additional plates and liners.

By using a method and a container according to the present invention, several distinct advantages can be gained over existing arrangements.

Firstly, the transverse metal plate(s) in each canister acts to transfer heat from the exterior of the canister to the interior of the material contained therein, which reduces heating time and provide a more uniform temperature distribution throughout the material in a pre heating step of economically short time.

Secondly, as the canister is compressed during the high temperature and pressure sintering process, the plates act to prevent, or at least substantially reduce, gross or significant radial outward deformation of the canister walls and, in doing so, maintain the generally cylindrical shape of the canister with the plates and end walls at right angles to the general cylinder of the side wall.

As an additional advantage canisters of increased height can be employed thus allowing storage of greater quantities of material. Finally, it has been found that the particular shape of aperture 14' described above in relation to the embodiments, namely, the four leaf clover configured aperture, provides uniform high material packing density during filling of the respective canister and prevents low density areas of material immediately below it.

It is to be noted further, although the embodiments of the present invention described above are directed to a canister for use in the formation of an immobilised high level radioactive nuclear waste as a synthetic rock, the invention can also be used in other processes where rapid heating of a material within a container is required.

We claim:

1. A metal container for processing solid particulate material, comprising:

a generally-cylindrical container having a metal cylindrical side wall extending around the axis of the container with a bellows-like formation, and a base wall across one end of the side wall, for filling with solid particulate material and subjecting to heating and pressure, whereby the solid particulate material is processed, densified and adapted to be retained within the metal container; a lid opposite the base wall for closing the filled container; at least one apertured plate of thermally conductive material extending generally transversely across the container and attached in thermally conducting relationship to the side wall of the container, the apertured plate having spaced portions around the axis of the container and extending radially inwardly from the periphery of the apertured plate towards the axis for defining between the spaced portions apertures through which the particulate material falls when the container is being filled, the spaced portions of the plate being shaped and dimensioned for conducting heat to the particulate material in the central region of the container and for strengthening the container by resisting substantial radial deformation of the container during the application of pressure.

2. A container according to claim 1, characterized in that the plate is of a metal and extends in a plane normal to the axis of the container.

3. A container according to claim 1, characterised in that the aperture in the plate is substantially centrally located therein and is substantially of a four leaf clover configuration.

4. A container according to claim 1 characterized in that the apertured plate is shaped and dimensioned to prevent displacement of the base wall and the lid of the container transversely of the axis of the container during a hot uniaxial pressing of the container along the axis and at right angles to the general plane of the or each apertured plate.

5. A container according to claim 4, characterised in that a plurality of said apertured plates are provided, the plates being of metal and placed at substantially equally spaced intervals within and along the length of the container, the plates being welded to the outer wall.

6. A container according to claim 4, characterised in that at least one cylindrical screen is located adjacent the bellows like wall of the container and extends between the upper and lower limits of each compartment defined between the apertured plate or plates and the ends of the container, for the purpose of preventing the particulate material entering the bellows convolutions.

7. A container according to claim 6, characterised in that a series of holes are positioned around the periphery of the or each apertured plate to enable air transfer between different compartments formed between the liner and adjacent bellows convolutions.

8. A container according to either claim 6, characterised in that Zircaloy is placed in the compartments formed between the liner and the container convolutions.

* * * * *